US008961158B2

(12) United States Patent
Oka et al.

(10) Patent No.: US 8,961,158 B2
(45) Date of Patent: Feb. 24, 2015

(54) SCROLL COMPRESSOR INCLUDING INTERMITTENT BACK PRESSURE CHAMBER COMMUNICATION

(75) Inventors: Souichirou Oka, Sakai (JP); Yohei Nishide, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 27 days.

(21) Appl. No.: 13/395,767

(22) PCT Filed: Sep. 15, 2010

(86) PCT No.: PCT/JP2010/065926

§ 371 (c)(1),
(2), (4) Date: Mar. 13, 2012

(87) PCT Pub. No.: WO2011/034082

PCT Pub. Date: Mar. 24, 2011

(65) Prior Publication Data

US 2012/0177521 A1 Jul. 12, 2012

(30) Foreign Application Priority Data

Sep. 18, 2009 (JP) ..... 2009-217799

(51) Int. Cl.
*F04C 18/02* (2006.01)
*F04C 23/00* (2006.01)
*F04C 27/00* (2006.01)

(52) U.S. Cl.
CPC ..... *F04C 18/0215* (2013.01); *F04C 18/0253* (2013.01); *F04C 23/008* (2013.01); *F04C 27/005* (2013.01)
USPC ..... 418/55.1; 418/55.5

(58) Field of Classification Search
CPC ..... F04C 18/0215; F04C 18/0253; F04C 23/008; F04C 27/005
USPC ..... 418/55.1, 55.5, 55.6, 55.2, 55, 3, 55.4
See application file for complete search history.

(56) References Cited

U.S. PATENT DOCUMENTS 4,596,521 A * 6/1986 Murayama et al. ..... 418/55.1
8,651,842 B2 * 2/2014 Yamamoto et al. ..... 418/55.5

(Continued)

FOREIGN PATENT DOCUMENTS

JP 59-180094 A 10/1984
JP 4-175483 A 6/1992

(Continued)

OTHER PUBLICATIONS

International Search Report of corresponding PCT Application No. PCT/JP2010/065926, Dated Dec. 21, 2010.

*Primary Examiner* — Mary A Davis
*Assistant Examiner* — Paul Thiede
(74) *Attorney, Agent, or Firm* — Global IP Counselors

(57) ABSTRACT

A scroll compressor includes a stationary scroll and a movable scroll. Each scroll has a helical lap provided on one surface of an individual panel. The laps are brought together to form a compression chamber between the laps. A back pressure chamber is formed in a side of the panel of the movable scroll that is opposite of a side where the lap is formed. At least one concave part capable of communicating with the compression chamber is formed in the surface of the panel of the stationary scroll where the lap is formed. At least one throughhole is formed in the panel of the movable scroll. The throughhole is formed through a thickness direction of the panel of the movable scroll and is configured to intermittently cause the concave part and the back pressure chamber to communicate.

13 Claims, 4 Drawing Sheets

(56) References Cited

U.S. PATENT DOCUMENTS

| | | | | |
|---|---|---|---|---|
| 2002/0039540 | A1 | 4/2002 | Kuroki et al. | |
| 2007/0231172 | A1 | 10/2007 | Fujimura et al. | |
| 2011/0158838 | A1* | 6/2011 | Nishide | 418/55.1 |
| 2013/0078131 | A1* | 3/2013 | Ahn et al. | 418/55.4 |

FOREIGN PATENT DOCUMENTS

| | | | |
|---|---|---|---|
| JP | 2707517 | B | 10/1997 |
| JP | 2002-106482 | A | 4/2002 |
| JP | 2007-270697 | A | 10/2007 |
| JP | 2008-121624 | A | 5/2008 |

* cited by examiner

SCROLL COMPRESSOR INCLUDING INTERMITTENT BACK PRESSURE CHAMBER COMMUNICATION

CROSS-REFERENCE TO RELATED APPLICATIONS

This U.S. National stage application claims priority under 35 U.S.C. §119(a) to Japanese Patent Application No. 2009-217799, filed in Japan on Sep. 18, 2009, the entire contents of which are hereby incorporated herein by reference.

TECHNICAL FIELD

The present invention relates to a scroll compressor for intermittently leading intermediate pressure into a back pressure chamber of a movable scroll.

BACKGROUND ART

In the past, there has been proposed a scroll compressor for intermittently leading intermediate pressure into a back pressure chamber of a movable scroll, in order to obtain thrust pressure for pressing a movable scroll against a stationary scroll.

For example, the scroll compressor according to (Japanese Patent Registration No. 2707517 has a structure in which intermediate pressure is intermittently led in by the turning motion of a movable scroll, and the intermediate pressure is supplied to an inlet passage of a stationary scroll via a connecting passage of the movable scroll.

In this structure, the connecting passage of the movable scroll is formed through the interior of a panel, in a radial direction from the center toward the peripheral edge. The end of the connecting passage near the center of the panel communicates with a compression chamber in proximity to the center of the scroll. The peripheral-edge end of the connecting passage is intermittently communicated with a recess formed in a panel of the stationary scroll only when the end overlaps the position of the recess. The recess is then caused to communicate with a back pressure chamber positioned on a side opposite a lap of the movable scroll.

Thereby, when the peripheral-edge end of the connecting passage overlaps the recess of the stationary scroll, the compression chamber and the back pressure chamber are intermittently caused to communicate via the connecting passage and the recess, and as a result, intermediate pressure can be led into the back pressure chamber.

SUMMARY

However, in the structure of the scroll compressor of Japanese Patent Registration No. 2707517 described above, the length of the intermediate pressure connecting passage must be approximately equal to the radius of the panel of the movable scroll, which is considerably long. Therefore, the structure has considerable dead volume.

As a result, with this scroll compressor, it is difficult to obtain the optimal thrust pressure and the desired intermediate pressure cannot be obtained efficiently; therefore, it is difficult to suppress pulsation and improve intermediate pressure conformance.

An object of the present invention is to provide a scroll compressor in which pulsation is suppressed, intermediate pressure conformance can be improved, and dead volume can be reduced.

A scroll compressor of a first aspect comprises a stationary scroll and a movable scroll, each of which scrolls having a helical lap provided to one surface of individual panels. The lap of the stationary scroll and the lap of the movable scroll are brought together, whereby a compression chamber is formed between the adjacent lap of the stationary scroll and lap of the movable scroll. A back pressure chamber is formed in the side of the panel of the movable scroll that is opposite of the side where the lap is formed. At least one concave part capable of communicating with the compression chamber is formed in the surface of the panel of the stationary scroll on the side where the lap is formed. At least one through-hole capable of intermittently causing the concave part and the back pressure chamber to communicate is formed in the panel of the movable scroll, the through-hole being formed through a thickness direction of the panel of the movable scroll.

Since at least one concave part capable of communicating with the compression chamber is formed in the surface of the panel of the stationary scroll on the side where the lap is formed, and at least one through-hole capable of intermittently causing the concave part and the back pressure chamber to communicate is formed in the panel of the movable scroll, the through-hole being formed through the thickness direction of the panel of the movable scroll; the concave part and the through-hole can be smaller than a conventional connecting passage for leading in intermediate pressure. As a result, the desired intermediate pressure can be efficiently led into the back pressure chamber, pulsation can be suppressed, and intermediate pressure conformance can be improved.

A scroll compressor of a second aspect is the scroll compressor of the first aspect, wherein the concave part is a groove extending in a direction that intersects a trajectory over which the through-hole moves along with the revolving of the movable scroll.

By using as the concave part a groove extending in a direction that intersects the trajectory over which the through-hole moves along with the revolving of the movable scroll, the groove and the through-hole can be reliably caused to communicate at a pinpoint.

A scroll compressor of a third aspect is the scroll compressor of the second aspect, wherein the groove extends in a direction orthogonal to the trajectory over which the through-hole moves along with the revolving of the movable scroll.

Since the groove extends in a direction orthogonal to the trajectory over which the through-hole moves along with the revolving of the movable scroll, the groove and the through-hole can be reliably caused to communicate in the shortest amount of time. The desired intermediate pressure can thereby be led into the back pressure chamber, pulsation can be suppressed, and a stable intermediate pressure can be led in.

A scroll compressor of a fourth aspect is the scroll compressor of any of the first through third aspects, wherein the through-hole has a cross section in the shape of an oblong hole.

Since the through-hole has a cross section in the shape of an oblong hole, pulsation can be suppressed, and intermediate pressure conformance can be improved. Moreover, intermediate pressure conformance can be further improved without increasing the communication time duration.

A scroll compressor of a fifth aspect is the scroll compressor of any of the first through fourth aspects, wherein a plurality of through-holes are formed, and two or more through-holes can be communicated simultaneously with the concave part.

Since a plurality of through-holes are formed and two or more through-holes can communicate simultaneously with the concave part, pulsation can be suppressed and intermediate pressure conformance can be improved. Moreover, intermediate pressure conformance can be further improved without increasing the communication time duration.

A scroll compressor of a sixth aspect is the scroll compressor of any of the first through fifth aspects, wherein the concave part is formed in a space one circumference inward from an outermost side of the lap of the stationary scroll.

Since the concave part is formed in a space one circumference inward from an outermost side of the lap of the stationary scroll, there is little thrust loss, an intermediate pressure at which the movable scroll does not turn over can be reliably obtained, and the concave part can be reliably formed in a position where it will not interfere with other components.

DESCRIPTION OF EMBODIMENTS (Embodiments)

Next, an embodiment of the scroll compressor of the present invention is described with reference to the drawings.

Figure 1:
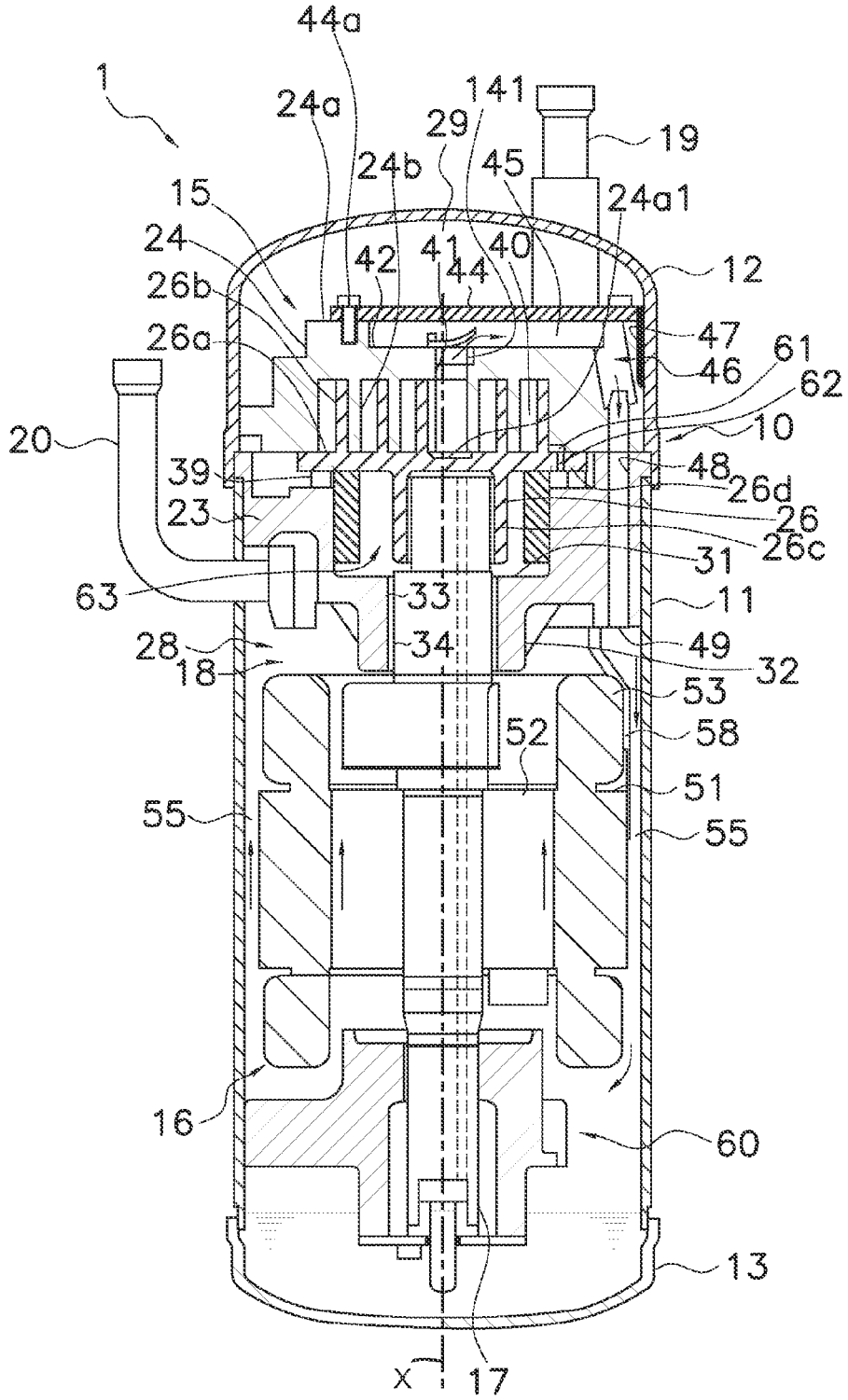
FIG. 1 is a longitudinal cross-sectional view of a scroll compressor relating to an embodiment of the present invention.

A scroll compressor 1 shown in FIG. 1 is a high-low pressure dome-type scroll compressor and constitutes a refrigerant circuit together with an evaporator and/or a condenser, an expansion mechanism, and other components. The scroll compressor 1 fulfills the role of compressing a gas refrigerant in the refrigerant circuit, and the scroll compressor 1 is configured primarily from a long cylindrical hermetic dome-type casing 10, a scroll compressor mechanism 15, an Oldham ring 39, a drive motor 16, a lower main bearing 60, an intake tube 19, and a discharge tube 20. Each of the configurational components of this scroll compressor 1 is described below in detail.

(Details of Configurational Components of Scroll Compressor 1)

(1) Casing

The casing 10 has a substantially cylindrical core casing part 11, a bowl-shaped top wall part 12 hermetically welded to the upper end of the core casing part 11, and a bowl-shaped bottom wall part 13 hermetically welded to the lower end part of the core casing part 11. Accommodated in the casing 10 are, primarily, the scroll compressor mechanism 15 for compressing a gas refrigerant, and the drive motor 16 disposed below the scroll compressor mechanism 15. The scroll compressor mechanism 15 and the drive motor 16 are connected by a drive shaft 17 disposed so as to extend vertically within the casing 10. The drive shaft has a longitudinal center axis of rotation X extending in an axial direction, with a radial direction being relative to the longitudinal center axis X. As a result, a gap space 18 is formed between the scroll compressor mechanism 15 and the drive motor 16.

(2) Scroll Compressor Mechanism

The scroll compressor mechanism 15 is configured primarily from a housing 23, a stationary scroll 24 disposed as being secured in place above the housing 23, and a movable scroll 26 which meshes with the stationary scroll 24, as shown in FIG. 1.

Each of the configurational components of the scroll compressor mechanism 15 is described below in detail.

a) Stationary Scroll

The stationary scroll 24 is configured primarily from a flat plate-shaped panel 24*a*, and a spiral (involute) lap 24*b* formed on the lower surface of the panel 24*a*, as shown in FIG. 1.

Figure 4:
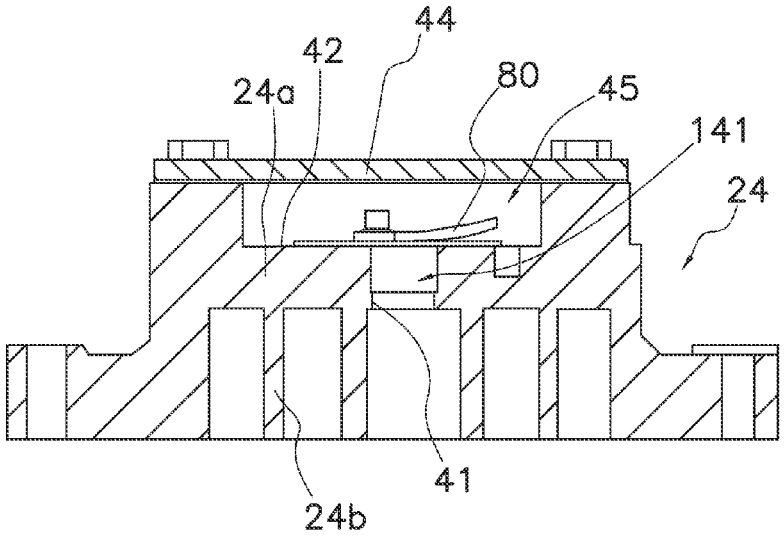
FIG. 4 is a longitudinal cross-sectional view of the stationary scroll of FIG. 1.

In the panel 24*a*, a discharge port 41 communicating with a compression chamber 40, described hereinafter, is formed through the approximate center of the panel 24*a*. The discharge port 41 is formed so as to extend vertically in the center portion of the panel 24*a*. The shape of the opening surface of the discharge port 41 is not circular because the opening surface area is increased to reduce discharge pressure drop. A counterbore space 141 (see FIG. 4) communicating with the discharge port 41 is formed in the top surface of the panel 24*a*. The symbol 80 in FIG. 4 indicates a discharge valve, which is a non-return valve for opening and closing the counterbore space 141.

Furthermore, an enlarged concave part 42 (see FIG. 1) communicating with the discharge port 41 and the counterbore space 141 is formed in the top surface of the panel 24*a*. The enlarged concave part 42 is configured from a concave part which is recessed into the top surface of the panel 24*a* and which widens horizontally. A lid member 44 is fastened in place to the top surface of the stationary scroll 24 by a bolt 44*a* so as to close up the enlarged concave part 42. Formed in the enlarged concave part 42 is a muffler space 45 composed of an expansion chamber which reduces the operating noises of the scroll compressor mechanism 15 due to being covered up by the lid member 44. The stationary scroll 24 and the lid member 44 are sealed by being stuck together with a packing (not shown).

b) Moveable Scroll

The movable scroll 26 is configured primarily from a panel 26*a*, a spiral (involute) lap 26*b* formed on the top surface of the panel 26*a*, a bearing part 26*c* formed on the lower surface of the panel 26*a*, and a groove part 26*d* formed in both ends of the panel 26*a*, as shown in FIG. 1.

The movable scroll 26 is an outer drive movable scroll. Specifically, the movable scroll 26 has the bearing part 26*c* which fits with the outer side of the drive shaft 17.

The movable scroll 26 is supported on the housing 23 by the Oldham ring 39 being fitted into the groove part 26d, The upper end of the drive shaft 17 is fittably inserted into the bearing part 26*c*. Due to being assembled in the scroll compressor mechanism 15 in this manner, the movable scroll 26 revolves within the housing 23 without being spun by the rotation of the drive shaft 17. Thus, the drive shaft 17 is coupled to the movable scroll 26 to cause the movable scroll 26 to revolve in res souse to rotation of the drive shaft 17, The lap 26b of the movable scroll 26 is meshed with the lap 24*b* of the stationary scroll 24, and the compression chamber 40 is formed between the connecting parts of the two laps 24*b*, 26*b*. In this compression chamber 40, as the movable scroll 26 revolves, the volume between the two laps 24*b*, 26*b* contracts toward the center. In the scroll compressor 1 according to the present embodiment, the gas refrigerant is compressed in this manner.

<Description of Intermediate Pressure Groove>

Figure 2:
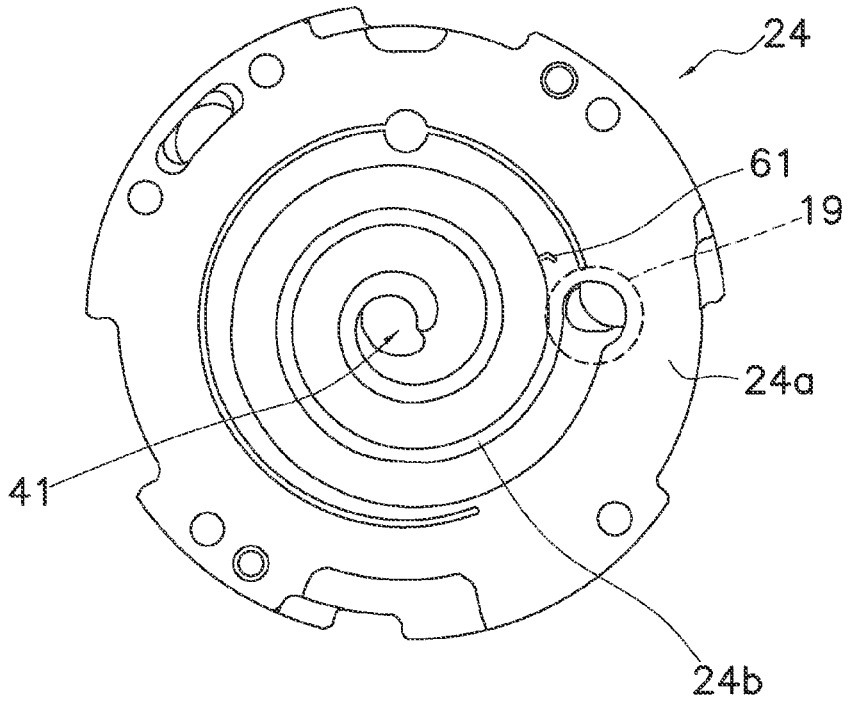
FIG. 2 is a drawing of the stationary scroll of FIG. 1 as seen from below.
Figure 3:
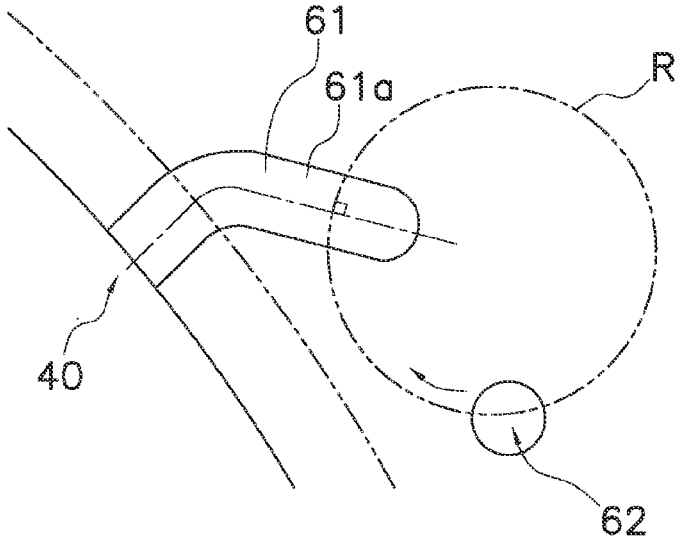
FIG. 3 is a drawing schematically showing the placement of the intermediate pressure groove formed in the stationary scroll of FIG. 1.

A back pressure chamber 63 is formed in the panel 26*a* of the movable scroll 26, on the side that is opposite the side where the lap 26*b* is formed, as shown in FIGS. 1 to 3. The back pressure chamber 63 is a space enclosed by a housing concave part 31 recessed into the center of the top surface of the housing 23, the panel 26*a* of the movable scroll 26, and the Oldham ring 39.

An intermediate pressure groove 61 that can communicate with the compression chamber 40 is formed in the surface of the panel 24*a* of the stationary scroll 24 in the side where the lap 26*b* is formed.

In the panel 26*a* of the movable scroll 26, a through-hole 62. capable of intermittently causing the intermediate pressure groove 61 to communicate with the back pressure chamber 63 is formed through the thickness direction of the panel 26*a* of the movable scroll 26. The through-hole 62 of FIG. 3 is a round hole.

The turning motion of the movable scroll 26 causes the through-hole 62 in the movable scroll 26 to move along a circular rotation trajectory R relative to the intermediate pressure groove 61 in the stationary scroll 24, as shown in FIG. 3. Consequently, when the through-hole 62 overlaps the intermediate pressure groove 61, intermediate pressure can be led into the back pressure chamber 63.

Thus, since the intermediate pressure groove 61 communicating with the compression chamber 40 is formed in the panel 24*a* of the stationary scroll 24, and the through-hole 62 allowing the intermediate pressure groove 61 to communicate with the back pressure chamber 63 is formed in the panel 26*a* of the movable scroll 26, the intermediate pressure groove 61 and the through-hole 62 can be smaller than a conventional connecting passage for leading in intermediate pressure. As a result, the desired intermediate pressure can be efficiently led into the back pressure chamber 63, pulsation is suppressed, and intermediate pressure conformance can be improved.

Figure 5:
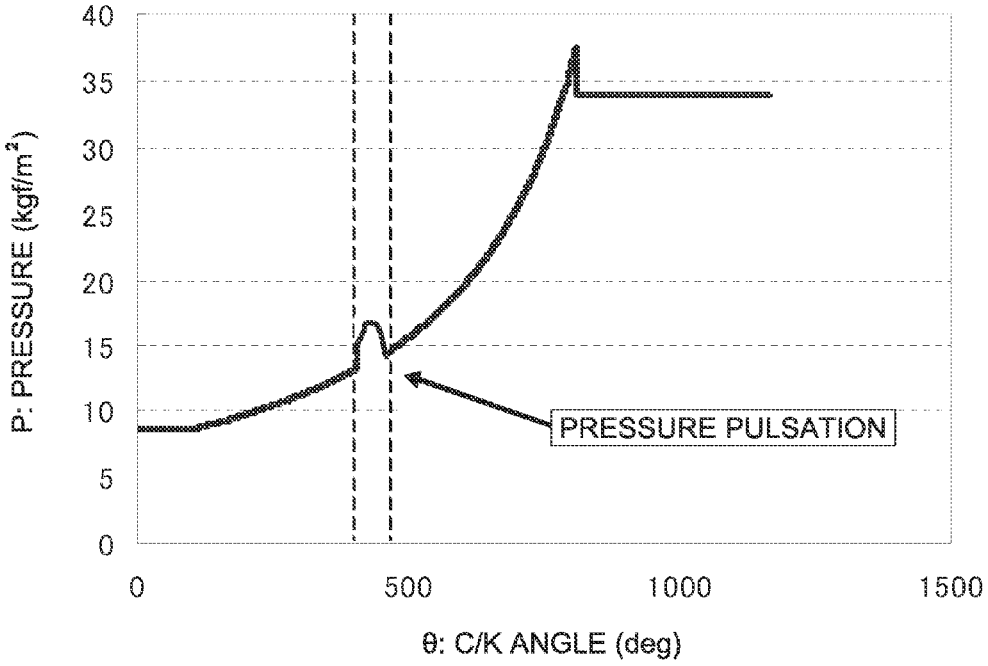
FIG. 5 is a graph showing the relationship between crank angle and discharge pressure.

Pulsation is a phenomenon whereby discharge pressure P rises locally within a predetermined crank angle θ range, as can be seen from the relationship between crank angle θ (degrees) and discharge pressure P (kgf/mm$^2$), as shown in FIG. 5.

The intermediate pressure groove 61 has a shape wherein a distal end part 61*a* bends so as to extend in a direction of intersecting with the rotation trajectory R in which the through-hole 62 moves along with the revolving of the movable scroll 26, as shown in FIGS. 2 and 3.

Particularly, the distal end part 61*a* of the intermediate pressure groove 61 extends in a direction orthogonal to the rotation trajectory R in which the through-hole 62. moves along with the revolving of the movable scroll 26.

The intermediate pressure groove 61 herein has a shape in which the distal end part 61*a* bends so as to be orthogonal to the rotation trajectory R, but the intermediate pressure groove 61 can also be formed into a linear shape, or the intermediate pressure groove 61 can be lengthened.

The intermediate pressure groove 61 is formed in the space one circumference inward from the outermost side of the lap 24*b* of the stationary scroll 24, as shown in FIG. 2.

c) Housing

The housing 23 is press-fitted and fixed in place in the core casing part 11 through the entire circumferential direction of its external peripheral surface. In other words, the core casing part 11 and the housing 23 are hermetically sealed together through their entire circumferences. Therefore, the interior of the casing 10 is divided into a high-pressure space 28 below the housing 23 and a low-pressure space 29 above the housing 23. The stationary scroll 24 is fixed by a bolt or the like to the housing 23 so that the upper end surface of the housing is sealed to the lower end surface of the stationary scroll 24. Also formed in the housing 23 are the housing concave part 31 recessed into the center of the top surface, and a bearing part 32 protruding downward from the center of the lower surface. A bearing hole 33 is formed vertically through the bearing part 32, and the drive shaft 17 is rotatably fitted into the bearing hole 33 via a bearing 34.

d) Others

A connecting passage 46 is formed in the scroll compressor mechanism 15, extending through the stationary scroll 24 and the housing 23. The connecting passage 46 is formed so that the stationary scroll 24 communicates with a housing-side passage 48 formed as a notch in the housing 23. The upper end of the connecting passage 46 opens into the enlarged concave part 42, and the lower end of the connecting passage 46, i.e., the lower end of the housing-side passage 48, opens into the lower end surface of the housing 23. In other words, a discharge port 49 which allows the refrigerant in the connecting passage 46 to flow out to the gap space 18 is configured from the lower end opening of the housing-side passage 48.

(3) Oldham ring

The Oldham ring 39 is a member for preventing spinning movement of the movable scroll 26 as described above, and is fitted into Oldham grooves (not shown) formed in the housing 23. These Oldham grooves are elliptical grooves and are set in positions that face each other in the housing 23.

(4) Drive Motor

The drive motor 16 is a DC motor in the present embodiment, and is configured primarily from an annular stator 51 fixed to the inner wall surface of the casing 10, and a rotor 52 rotatably accommodated so that a slight gap (an air gap passage) is present relative to the inner side of the stator 51. The drive motor 16 is disposed so that the upper end of a coil end 53 formed in the top side of the stator 51 is positioned at approximately the same height as the lower end of the bearing part 32 of the housing 23.

A copper wire is wound around the teeth of the stator 51, and the coil end 53 is formed above and below. The external peripheral surface of the stator 51 is provided with core-cut parts formed as notches in a plurality of locations from the upper end surface to the lower end surface of the stator 51, at predetermined intervals in the circumferential direction.

A motor cooling passage 55, which extends vertically between the core casing part 11 and the stator 51, is formed by these core-cut parts.

The rotor 52 is driveably connected to the movable scroll 26 of the scroll compressor mechanism 15 via the drive shaft 17, which is disposed in the axial center of the core casing part 11 so as to extend vertically. A guide plate 58 for guiding refrigerant flowing out of the discharge port 49 of the connecting passage 46 into the motor cooling passage 55 is set in the gap space 18.

(5) Lower Main Bearing

The lower main bearing 60 is set in a lower space below the drive motor 16. This lower main bearing 60, which is fixed to the core casing part 11, constitutes a lower-end bearing of the drive shaft 17 and supports the drive shaft 17.

(6) Intake Tube

The intake tube 19 is for leading the refrigerant of the refrigerant circuit to the scroll compressor mechanism 15, and is hermetically fitted into the top wall part 12 of the casing 10. The intake tube 19 passes vertically through the low-pressure space 29, and an inner end part thereof is fitted into the stationary scroll 24.

(7) Discharge Tube

The discharge tube 20 is for discharging the refrigerant in the casing 10 out of the casing 10, and is hermetically fitted into the core casing part 11 of the casing 10. The discharge tube 20 opens in a position protruding downward to the center from the inside surface of the core body, and the discharge tube 20 communicates with the gap space which is the high-pressure space 28.

(Movement Action of Scroll Compressor 1)

Next, the movement action of the scroll compressor 1 is described in a simple manner while referring to FIG. 1, First, when the drive motor 16 is driven, the drive shaft 17 rotates, and the movable scroll 26 performs a revolving movement without spinning A low-pressure gas refrigerant is then drawn into the compression chamber 40 from the peripheral edge of the compression chamber 40 through the intake tube 19, and the refrigerant is compressed as the capacity of the compression chamber 40 changes, forming a high-pressure gas refrigerant. This high-pressure gas refrigerant is discharged from the center of the compression chamber 40, through the discharge port 41 and the counterbore space 141, into the muffler space 45.

Additionally, white the movable scroll 26 is undergoing the turning movement, when the through-hole 62 passing through the panel 26*a* of the movable scroll 26 in the thickness direction communicates with the intermediate pressure groove 61 formed in the panel 24*a* of the stationary scroll 24, the compression chamber 40 communicates with the back pressure chamber 63 on the lower side of the movable scroll 26 via the intermediate pressure groove 61 and the through-hole 62. The desired intermediate pressure can thereby be efficiently led into the back pressure chamber 63, pulsation is suppressed, and intermediate pressure conformance can be improved.

The refrigerant then flows out to the gap space 18 through the connecting passage 46, the housing-side passage 48, and the discharge port 49, and flows downward between the guide plate 58 and the inner surface of the core casing part 11. When this gas refrigerant flows downward between the guide plate 58 and the inner surface of the core casing part 11, some is diverted to flow circumferentially between the guide plate 58 and the drive motor 16, and the lubrication oil mixed in the gas refrigerant is separated from the refrigerant. The rest of the diverted gas refrigerant flows downward through the motor cooling passage 55 until it reaches a motor lower space, after which it reverses and flows upward through the air gap passage between the stator 51 and the rotor 52 or the motor cooling passage 55 on the side (the left side in FIG. 1) facing the connecting passage 46. The gas refrigerant that has passed through the guide plate 58 and the gas refrigerant that has flowed through the air gap passage or the motor cooling passage 55 are then mixed together in the gap space 18 and discharged from the discharge tube 20 out of the casing 10. After circulating through the refrigerant circuit, the gas refrigerant discharged out of the casing 10 is drawn back through the intake tube 19 into the scroll compressor mechanism 15, where it is compressed.

<Characteristics of Embodiment>

(1)

In the scroll compressor 1 of the embodiment, the turning movement of the movable scroll 26 causes the through-hole 62 in the movable scroll 26 to move along a circular rotation trajectory R relative to the intermediate pressure groove 61 in the stationary scroll 24, as shown in FIG. 3. Consequently, intermediate pressure can be led in when the through-hole 62 overlaps the intermediate pressure groove 61, and intermediate pressure cannot be led in when there is no overlap.

Thus, since the intermediate pressure groove 61 communicating with the compression chamber 40 is formed in the panel 24*a* of the stationary scroll 24, and the through-hole 62 communicating the intermediate pressure groove 61 with the back pressure chamber 63 is formed in the panel 26*a* of the movable scroll 26, the intermediate pressure groove 61 and the through-hole 62 can be smaller than a conventional connecting passage for leading in intermediate pressure. As a result, the desired intermediate pressure can be efficiently led into the back pressure chamber 63, pulsation is suppressed, and intermediate pressure conformance can be improved.

(2)

Moreover, the intermediate pressure groove 61 of the stationary scroll 24 and the through-hole 62 of the movable scroll 26 can be formed smaller in width, and the pulsation per rotation in the turning of the movable scroll 26 can thereby be reduced.

The shape and surface area of the passageway whereby the intermediate pressure groove 61 and the through-hole 62 communicate with each rotation of the movable scroll 26 are appropriately varied, oil (the cause of mixing loss) that has accumulated in the back pressure chamber 63 and other intermediate pressure spaces (intermediate pressure chambers) can thereby be efficiently carried to the compression chamber 40, and oil can be ensured for the seal in the compression chamber 40.

As described above, by providing both the intermediate pressure groove 61 which is formed in the panel 24*a* of the stationary scroll 24 and communicates with the compression chamber 40, and the through-hole 62 which is formed in the panel 26*a* of the movable scroll 26 and which causes the intermediate pressure groove 61 to communicate with the back pressure chamber 63, the intermediate pressure obtained during compression inside the compression chamber 40 can be led into the back pressure chamber 63 at a pinpoint. As a result, pulsation can be suppressed and stable intermediate pressure can be led in.

Moreover, since the volume led in per rotation is small, dead volume can be reduced.

Furthermore, since the intermediate pressure groove 61 communicating with the compression chamber 40 is formed in the surface of the panel 24*a* of the stationary scroll 24, the intermediate pressure groove 61 is easily machined. The through-hole 62 communicating the intermediate pressure groove 61 and the back pressure chamber 63 can be formed easily due to passing through the panel 26*a* of the movable scroll 26 in the thickness direction.

(3)

In the scroll compressor 1 of the embodiment, since the intermediate pressure groove 61 extends in a direction that intersects the rotation trajectory R through which the through-hole 62 moves along with the revolving of the movable scroll 26 as shown in FIGS. 2 and 3, the intermediate pressure groove 61 and the through-hole 62 can reliably communicate at a pinpoint. The desired intermediate pressure can thereby be led into the back pressure chamber 63, pulsation can be suppressed, and stable intermediate pressure can be led in.

(4)

In the scroll compressor 1 of the embodiment, since the distal end part 61*a* of the intermediate pressure groove 61 extends in a direction orthogonal to the rotation trajectory R through which the through-hole 62 moves along with the revolving of the movable scroll 26, the intermediate pressure groove 61 and the through-hole 62 can reliably be in communication with each other in the shortest amount of time. The desired intermediate pressure can thereby be led into the back pressure chamber 63, pulsation can be suppressed, and stable intermediate pressure can be led in. Moreover, the volume led in per rotation can be reduced to a minimum, and dead volume can be reduced to a minimum.

(5)

Furthermore, in the scroll compressor 1 of the embodiment, since the intermediate pressure groove 61 is formed in the space one circumference inward from the outermost side of the lap 24*b* of the stationary scroll 24 as shown in FIG. 2, there is little thrust loss, an intermediate pressure at which the movable scroll 26 does not turn over can be reliably obtained, and the intermediate pressure groove 61 can be reliably formed in a position where it will not interfere with other components.

<Modifications of the Embodiment>

(A)

Figure 6:
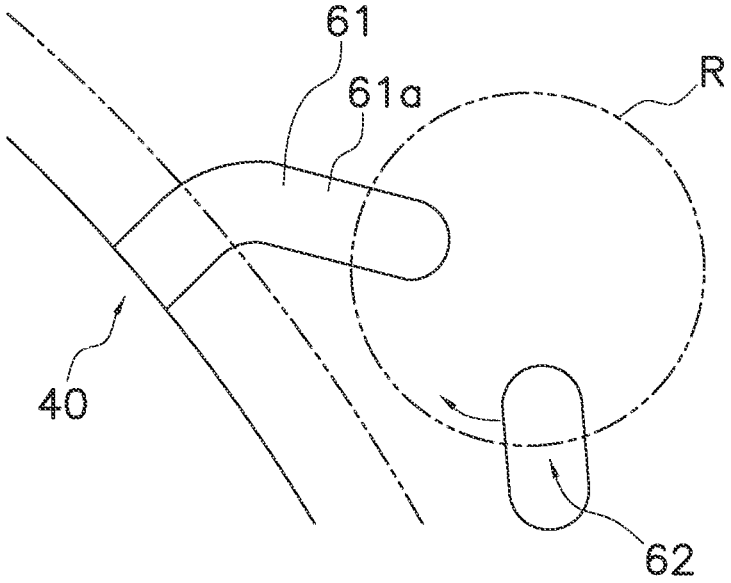
FIG. 6 is a drawing schematically showing the placement of the intermediate pressure groove formed in the stationary scroll according to a modification of the present invention.

The present invention is not limited to the example of the scroll compressor 1 of the above embodiment, wherein the through-hole 62 (see FIG. 3) having a circular cross section is formed in the panel 26*a* of the movable scroll 26, and through-holes of various other shapes may be used; e.g., a through-hole 62 having an elliptical cross section may be used as shown in FIG. 6. In this case, pulsation can be suppressed, and intermediate pressure conformance can be improved.

In particular, intermediate pressure conformance can be further improved without increasing the communication time duration by making the shape of the through-hole 62 for leading in intermediate pressure into an oblong hole.

(B)

Figure 7:
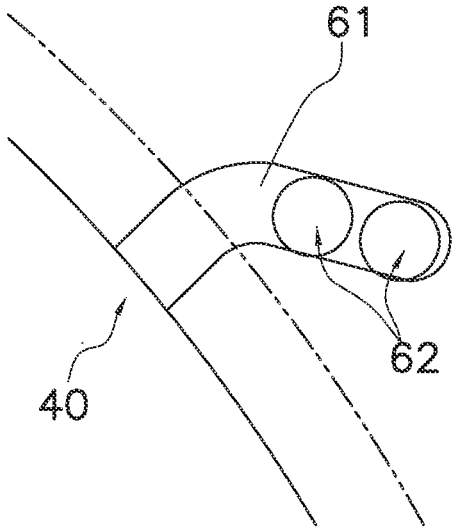
FIG. 7 is a drawing schematically showing the placement of the intermediate pressure groove formed in the stationary scroll according to another modification of the present invention.

As another modification, there may be a plurality of through-holes 62 as shown in FIG. 7. Two or more through-holes 62 are disposed so that they can be allowed to communicate simultaneously with the intermediate pressure groove 61. Pulsation can be suppressed and intermediate pressure conformance can be improved in this case as well.

Moreover, intermediate pressure conformance can be further improved without increasing the communication time duration by providing a plurality of through-holes 62.

A plurality of oblong holes such as the one of Modification (A) above may also be formed.

(C)

The degree of freedom in the position where the through-hole 62 is formed may also be increased and the restrictions on the position where the intermediate pressure is led in may be reduced by flattening the scroll shapes of the stationary scroll 24 and the movable scroll 26 and increasing their diameters.

Industrial Applicability

The present invention can be applied in various forms to a scroll compressor for intermittently leading intermediate pressure into the back pressure chamber of a movable scroll.

PATENT LITERATURE (Patent Literature 1) Japanese Patent Registration No. 2707517

What is claimed is:

1. A scroll compressor comprising:

a stationary scroll having a stationary panel and a spiral stationary lap provided on one surface of the stationary panel;

a movable scroll having a movable panel and a spiral movable lap provided on one surface of the movable panel, the stationary lap and the movable lap being brought together to form a compression chamber between the stationary and movable laps; and a drive shaft coupled to the movable scroll to cause the movable scroll to revolve in response to rotation of the rotation of the drive shaft, the drive shaft having a longitudinal center axis of rotation extending in an axial direction, with a radial direction being relative to the longitudinal center axis, a side of the movable panel that is opposite of a side where the movable lap is formed defining an axial end of a back pressure chamber, the surface of the stationary panel where the stationary lap is formed having at least one intermediate pressure groove formed therein that communicates with the compression chamber, the intermediate pressure groove having a radially inner end open in a radially inward direction to the compression chamber, and the movable panel having at least one hole formed therethrough in a thickness direction of the movable panel at a location radially outward of the radially inner end of the intermediate pressure groove, wherein when the scroll compressor operates such that movement of the movable panel occurs, the movement of the moveable panel intermittently locates the at least one hole in a position so that the intermediate pressure groove and the back pressure chamber communicate one to another through the at least one hole.

2. The scroll compressor according to claim 1, wherein the intermediate pressure groove extends in a direction that intersects a trajectory over which the through-hole moves when the movable scroll moves.

3. The scroll compressor according to claim 2, wherein the intermediate pressure groove extends in a direction orthogonal to the trajectory over which the through-hole moves when the movable scroll moves.

4. The scroll compressor according to claim 3, wherein the throughhole has a cross sectional shape of an oblong hole as viewed along the thickness direction of the movable panel.

5. The scroll compressor according to claim 3, wherein the at least one through hole includes a plurality of the through-holes; and the plurality of through holes are arranged such that two or more of the through-holes communicate simultaneously with the intermediate pressure groove.

6. The scroll compressor according to claim 2, wherein the through-hole has a cross sectional shape of an oblong hole as viewed along the thickness direction of the movable panel.

7. The scroll compressor according to claim 2, wherein the at least one through hole includes a plurality of the through-holes; and the plurality of through holes are arranged such that two or more of the through-holes communicate simultaneously with the intermediate pressure groove.

8. The scroll compressor according to claim 1, wherein the through-hole has a cross sectional shape of an oblong hole as viewed along the thickness direction of the movable panel.

9. The scroll compressor according to claim 8, wherein the intermediate pressure groove is fotmed in the stationary panel at a location disposed between an outermost portion of the stationary lap and a portion of the stationary lap located immediately radially inwardly of the outermost portion of the stationary lap.

10. The scroll compressor according to claim 1, wherein the at least one through hole includes a plurality of the through-holes; and the plurality of through holes are arranged such that two or more of the through-holes communicate simultaneously with the intermediate pressure groove.

11. The scroll compressor according to claim 10, wherein the intermediate pressure groove is formed in the stationary panel at a location disposed between an outermost portion of the stationary lap and a portion of the stationary lap located itnmediately radially inwardly of the outermost portion of the stationary lap.

12. The scroll compressor according to claim 1, wherein the intermediate pressure groove is formed in the stationary panel at a location disposed between an outermost portion of the stationary lap and a portion of the stationary lap located immediately radially inwardly of the outermost portion of the stationary lap.

13. The scroll compressor according to claim 1, wherein the intermediate pressure groove has a bend along its length intermediate the ends of the intermediate pressure groove.

* * * * *